United States Patent [19]

Ishikawa et al.

[11] Patent Number: 4,728,913

[45] Date of Patent: Mar. 1, 1988

[54] DIELECTRIC RESONATOR

[75] Inventors: Youhei Ishikawa; Hidekazu Wada; Kouichi Takehara, all of Nagaokakyo, Japan

[73] Assignee: Murata Manufacturing Co., Ltd., Japan

[21] Appl. No.: 820,194

[22] Filed: Jan. 17, 1986

[30] Foreign Application Priority Data

Jan. 18, 1985 [JP] Japan ..... 60-8201
Apr. 27, 1985 [JP] Japan ..... 60-92051

[51] Int. Cl.[4] ..... H01P 7/10

[52] U.S. Cl. ..... 333/235; 333/202; 333/219; 333/223

[58] Field of Search ..... 333/202, 206, 207, 209, 333/210, 211, 219, 221–223, 224, 226, 231, 234, 235, 208, 212, 236, 245, 248; 331/96, 107 DP

[56] References Cited

U.S. PATENT DOCUMENTS 2,825,842 3/1958 Kenyon ..... 333/232 X
4,521,746 6/1985 Hwan et al. ..... 333/219 X
4,630,012 12/1986 Fuller et al. ..... 333/219 X
4,639,699 1/1987 Nishikawa et al. ..... 333/202

FOREIGN PATENT DOCUMENTS 0154960 12/1979 Japan ..... 333/202
0085101 6/1980 Japan ..... 333/202
58-36002 3/1983 Japan ..... 333/202

*Primary Examiner*—Marvin L. Nussbaum
*Attorney, Agent, or Firm*—Ostrolenk, Faber, Gerb & Soffen

[57] ABSTRACT

A dielectric resonator comprises a shield electrode defining a resonant space and cylindrical dielectric resonator element disposed and supported fixedly in the resonant space, to which an input and output are coupled. Into the hollow portion of the dielectric resonator element, a tuning unit made of a dielectric material is inserted so as to be displaceable in an axial direction therein. The tuning unit is coupled to a supporting axis which is displaceable axially, thus causing the tuning unit to displace in that direction. A resonance frequency of the dielectric resonator varies as the tuning unit displaces.

14 Claims, 9 Drawing Figures

DIELECTRIC RESONATOR

BACKGROUND OF THE INVENTION

1. Field of the Invention

The present invention relates to a dielectric resonator. More specifically, the present invention relates to a structure for adjusting a resonant frequency of the dielectric resonator utilizing the $TE_{01\delta}$ mode or the modified mode thereof.

2. Description of the Prior Art

One example of the prior art is disclosed, for example, in Japanese Utility Model Laid Open No. 122909/1982. In this prior art document, the resonant frequency is disclosed to be adjusted in such a way that, a dielectric resonant element is retained within a metal case and a dielectric resonator utilizing the $TE_{01\delta}$ mode is realized. On the metal case, a metal screw is mounted so as to be brought close to or away from the dielectric resonator element by moving the screw up and down in adjusting the resonant frequency. For example, when the metal screw approaches the dielectric resonator element, the resonant frequency becomes higher.

In the prior art device using the metal screw, the adjustable range of the resonant frequency is narrow. For example, if the resonant frequency is fo and its variation is Δfo, the ratio Δfo/fo is found to be below 0.2% ($\Delta fo/fo \leqq 0.2\%$). This is because that, if the variation Δfo increases, the unloaded Q (Qo) deteriorates considerably and the ratio becomes $\Delta Qo/Qo \geqq 10\%$, which is not practical for use.

SUMMARY OF THE INVENTION

Therefore, a principal object of the present invention is to provide a dielectric resonator which is capable of adjusting the resonant frequency through a wider range without deteriorating the Qo.

In brief, the present invention relates to a dielectric resonator employing $TE_{01\delta}$ mode or the modified mode thereof, including a tuning unit made of a dielectric material displaceably retained within a space formed in a dielectric resonator element.

The tuning unit made of dielectric material as described above changes the effective dielectric constant in the dielectric resonator element thereof, and thereby changes the resonant frequency, based upon the perturbation theory.

According to the present invention, since the conventional metal screw is not used, and instead the tuning unit made of dielectric material is used, the deterioration of Qo due to the current concentration can be eliminated. Accordingly, the rate of change of the resonant frequency may be increased as compared with the prior art.

These objects and other objects, features, aspects and advantages of the present invention will become more apparent from the following detailed description of preferred embodiments of the present invention when taken in conjunction with the accompanying drawings.

DESCRIPTION OF THE PREFERRED EMBODIMENTS

Figure 1:
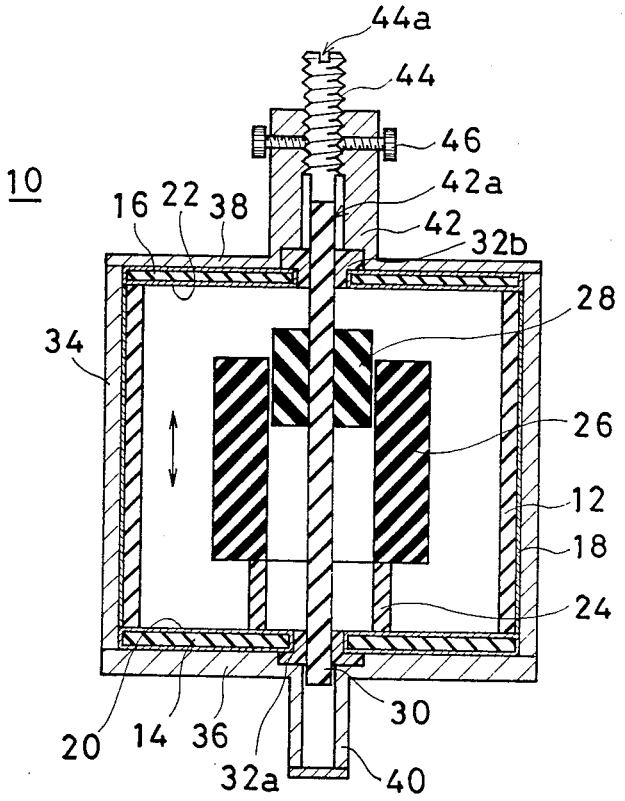
FIG. 1 is a sectional view showing one embodiment in accordance with the present invention.

FIG. 1 is a sectional view showing one embodiment in accordance with the present invention. A dielectric resonator 10 comprises a hollow cylindrical case 12 consisting of a dielectric material, such as a ceramic material. On lower and upper ends of the ceramic case 12, a bottom plate 14 and a cover plate 16 made similarly of the ceramic material are secured. Preferably, the case 12, bottom plate 14 and cover plate 16 are composed of a ceramic material such as an alumina, for example, having a linear expansion coefficient equal to, or approximate to, that of a dielectric resonator element 26 to be described below.

On the bottom and cover plates 14 and 16, apertures are formed generally in the center thereof, and shield electrodes 18, 20 and 22 consisting of a metal material, such as silver and or the like, are formed respectively on the outside surface of the cylindrical case 12 and entirely on all the surfaces of the bottom plate 14 and the cover plate 16. Thus, a shielded space is formed by these electrodes 18, 20 and 22.

On the bottom plate 14 inside the case 12, a cylindrical support 24 made of a low dielectric constant material such as forsterite is mounted generally in the center thereof. On the support 24, a hollow cylindrical dielectric resonator element 26 composed of a dielectric material having a high dielectric constant, such as a titanium oxide group ceramic, is secured. Thus, the dielectric resonator element 26 is maintained fixedly within the shield electrode or external electrode and the dielectric resonator 10 utilizing the $TE_{01\delta}$ mode is formed as a whole.

In the hollow portion of the hollow cylindrical dielectric resonator element 26, a hollow cylindrical tuning unit 28 consisting similarly of a dielectric material having a high dielectric constant, such as the titanium oxide group ceramic, is inserted therethrough. The outside diameter of the tuning unit 28 is made slightly smaller as compared with the inside diameter of the hollow portion of the dielectric resonator element 26. It is, therefore, possible to displace the tuning unit 28 axially, that is, in the direction indicated by the arrow in FIG. 1, without touching the inner surface of the hollow portion of the dielectric resonator element 26. In the hollow portion of the tuning unit 28, a supporting axis 30 consisting of a dielectric material having a comparatively low dielectric constant, such as forsterite or the like, is inserted therethrough, to which the tuning unit 28 is secured. Accordingly, in order to displce the tuning unit 28 in the arrow direction, the supporting axis 30 may be moved up and down in that direction. The lower and upper ends of the supporting axis 30 are positioned respectively in the apertures in the bottom plate 14 and the cover plate 16 by means of respective bushings 32*a* and 32*b*, made of a resin material having a low dielectric constant, such as Teflon (trademark), and retained therein while allowing smooth movement in the arrow direction.

Such dielectric resonator 10 is contained within a hollow cylindrical metal case 34 made of a metal material, for example, such as aluminum, and each of the electrodes 18, 20 and 22 is electrically connected and fixed mechanically to the inner surface of the metal case 34, for example, by means of soldering or the like. The metal case 34 also has a metal bottom plate 36 and a metal cover plate 38 mounted on the lower and upper ends thereof, in a manner similar to the structure of the dielectric case 12.

On the bottom plate 36, an axial projection 40 projecting downwardly is formed and the lower end of the supporting axis 30 is inserted into closed cylindrical space formed thereby. Accordingly, the inside diameter of the projection 40 is selected slightly larger than the outside diameter of the supporting axis 30. Also, on the cover plate 38, an axial projection 42 projecting upwardly is formed and the upper end of the supporting axis 30 is inserted into a cylindrical space 42*a* formed thereby.

Within the space 42*a* formed by the projection 42, the upper end portion of the supporting axis 30 is secured to the lower end portion of a tuning screw 44 made of, for example, brass or the like. The tuning screw 44 includes a male screw portion (not shown) formed engageably with a female screw portion (not shown) formed on the inner wall of the projection 42. Therefore, when turning the tuning screw 44 by inserting a jig (not shown), such as a screw driver or the like, into a groove 44*a* formed on the upper end thereof, the tuning screw 44 and the supporting axis 30 can be displaced in the arrow direction, thus displacing the tuning unit 28 in the arrow direction within the hollow portion of the dielectric resonator element 26. After suitably adjusting the resonant frequency fo by displacing in such a manner, the turning screw 44 is fixed by a fixing screw 46 formed on the side of the projection 42.

Figure 2:
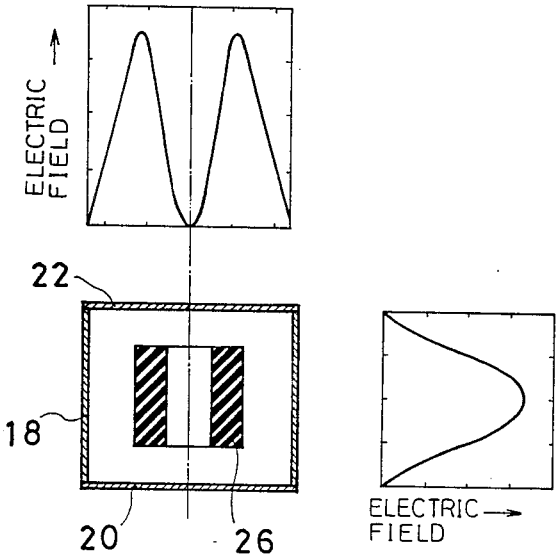
FIG. 2 is a view showing an electric field distribution in the state where a tuning unit is not inserted.

In such a construction, how the resonant frequency fo can be changed will be now described. An electric field distribution of the dielectric resonator in the state where the tuning unit 28 is not inserted is shown in FIG. 2. As it will be apparent from FIG. 2, in the hollow portion of the dielectric resonator element 26 where the tuning unit 28 would be inserted, an electric field strength is comparatively weak, and therefore, such electric field distribution will hardly be disturbed by inserting the tuning unit 28 thereinto. Thus, if the distribution as well as the strength of the electromagnetic field within the dielectric resonator will not essentially change, the following perturbation equation may be obtained.

$$\frac{\Delta fo}{fo} = \frac{\int_v \Delta\epsilon \cdot E_1 \cdot E_2^* \cdot dv}{\overline{Wt}}$$

where, fo is the resonant frequency before perturbation, Δfo: variation of the resonant frequency due to the perturbation, $\overline{Wt}$: a time average of the total energy within the resonator, Δε: variation of the effective dielectric constant, $E_1$: electric field vector before perturbation, $\bar{E}_2$: conjugate electric field vector after perturbation, V: effective volume of the dielectric resonator element.

As will be understood from the perturbation equation, by displacing the tuning unit 28, the effective dielectric constant ε at respective positions is changed and a variation Δε is produced, whereby the resonant frequency fo is changed.

Figure 3:
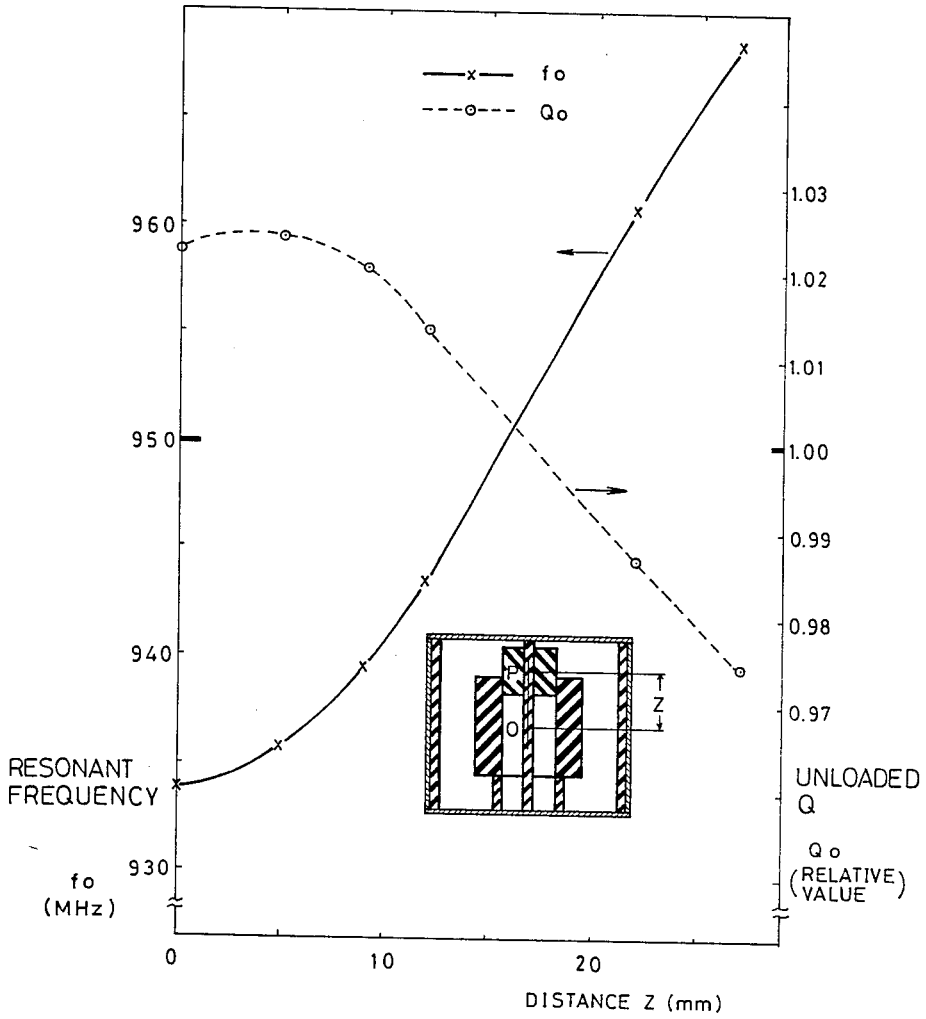
FIG. 3 is a graph showing the variation of fo and Qo against the displacement of the tuning unit, in which the distance Z (mm) is shown on the abscissa and the resonant frequency fo and the Qo are shown on the ordinate.

In such dielectric resonator 10, the state of variation of the resonant frequency fo and the Qo when the tuning unit 28 is displaced, is shown in FIG. 3, in which the distance Z (mm) shown on the abscissa represents the distance from the midpoint O in the axial direction of the dielectric resonator element 26 to the midpoint P in the axial direction of the tuning unit 28. As will be apparent from FIG. 3, according to the embodiment of FIG. 1, when the resonant frequency fo in the center is 950 MHz, the variation of Qo thereof was ΔQo/Qo=−2.1% even when changing the fo by Δfo/fo=2%. According to this embodiment, the frequency adjusting range Δfo/fo may be thus enlarged by more than ten times as compared with the prior art without significantly deteriorating the Qo.

Meanwhile, in the embodiment described above, the shield electrode is constructed by forming the electrodes 18, 20 and 22 on the dielectric case 12, bottom plate 14 and cover plate 16. This construction is for approximating the variation of the linear expansion coefficient of the shield electrode to that of the dielectric resonator element and minimizing the influence of the linear expansion coefficient of the shield electrode as much as possible. Accordingly, if any suitable compensating means is available, the shield electrode may be formed if desired entirely of metal.

Furthermore, the present invention is applicable in the case where the dielectric resonator element 26 is fixed directly or indirectly via the support fixed on a base plate of a strip line, in addition to the case in which it is maintained in the shield electrode.

Moreover, in the embodiment described above, the dielectric resonator was constructed as a generally cylindrical or columnar shape and employed the $TE_{01\delta}$ mode in cylindrical coordinates. However, a dielectric resonator element or a case having a hollow square shape may also be used, wherein the mode will be the modified $TE_{11\delta}$ mode in orthogonal coordinates.

Figure 4:
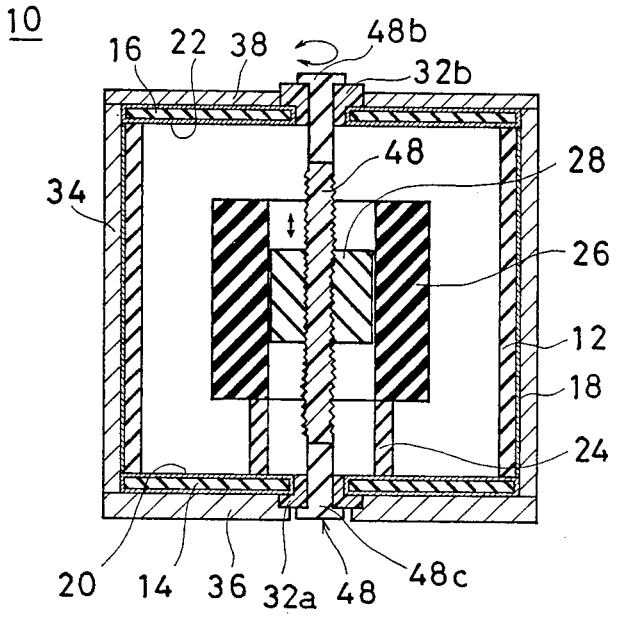
FIG. 4 is a sectional view showing another embodiment in accordance with the present invention.

FIG. 4 is a sectional view showing another embodiment in accordance with the present invention. The embodiment is similar to the first embodiment except for the following points, so duplicate description of similar elements will be omitted here.

In this embodiment, in order to make the tuning unit 28 displaceable, a female screw is formed by threading the center thereof. A male screw formed on the circumference of the supporting axis, which in this embodiment is a rotating axis 48, is screwed into the female screw of the tuning unit 28. On the rotating axis 48, supports 48*b* and 48*c* made of ceramics are secured to the upper and lower ends of the screw portion 48*a*, which may be a resin rod, on which the male screw is formed. The upper and lower ends of the supports 48*b* and 48*c* of the rotating axis 48 are respectively positioned and rotatably supported by the bushings 32*a* and 32*b* as previously described.

Figure 5:
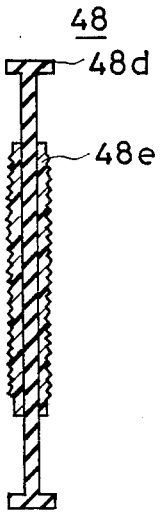
FIG. 5 is a longitudinal sectional view showing another example of the rotating axis.

Thus, the rotating axis 48 may be made totally of resin material as shown in the drawing, preferably having the same degree of linear expansion coefficient as the tuning unit 28. Alternatively, as the rotating axis 48, a molded male screw portion 48e made of a resin material may be formed on the circumference of the ceramic rod 48d as shown in FIG. 5. As a further alternative, the rotating axis 48 may be totally made of a ceramic material.

Figure 6:
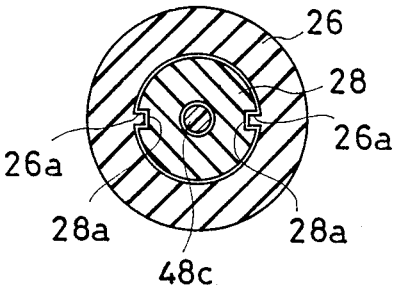
FIG. 6 is a transverse sectional view showing a dielectric resonator element and a tuning unit.

Furthermore, in order to stop the tuning unit 28 from rotating with the rotation of the rotating axis 48, a rotation control means associated with the dielectric resonator element 26 and the tuning unit 28 is provided. That is, on the inner circumference of the hollow cylindrical portion of the dielectric resonator element 26, guide bars 26a projecting inwardly are formed axially as shown in FIG. 6, and engage grooves 28a formed axially along the outer circumference of the tuning unit 28 for engagement with the guide bars 26a. Thereby, the tuning unit 28 is constrained to move up and down since the rotation thereof is stopped by the engagement between the engaging grooves 28a and the guide bars 26a even when the rotating axis 48 rotates.

Figure 7:
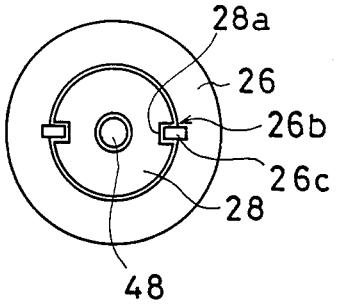
FIGS. 7 and 8 are plan views respectively showing other examples of a dielectric resonator element and a tuning unit.
Figure 8:
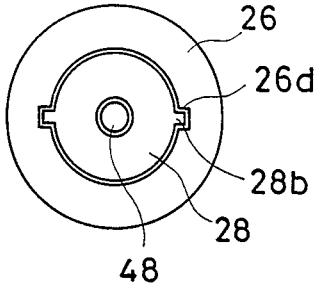

Other means for stopping the tuning unit 28 from rotating with the rotation of the rotating axis 48, are shown in FIGS. 7 and 8.

In the embodiment of FIG. 7, the engaging grooves 26b are formed axially along the inner circumference of the hollow cylindrical portion of the dielectric resonator element 26, and rod shaped guide bars 26c having a rectangular section are in the engaging grooves 26b and secured to the dielectric resonator element 26.

In the embodiment of FIG. 8, engaging grooves 26d are formed axially along the inner circumference of the hollow cylindrical portion of the dielectric resonator element 26, and engaging projections 28b are formed axially along the outer circumference of the tuning unit 28 for engaging the grooves 26d.

However, in the case where the dielectric resonator element 26 has a hollow cylindrical shape defining an inner space that is generally circular but not a regular circle, and the tuning unit 28 has a cylindrical shape with an outer cross section that is generally circular but not exactly the same as the inner space defined by the resonator element or in the case where the inner space of the dielectric resonator element 26 and the tuning unit 28 are square or the equivalent in cross-section, the rotation of the tuning unit 28 may be controlled by its shape alone, without providing separate means for controlling the rotation of the tuning unit 28.

Figure 9:
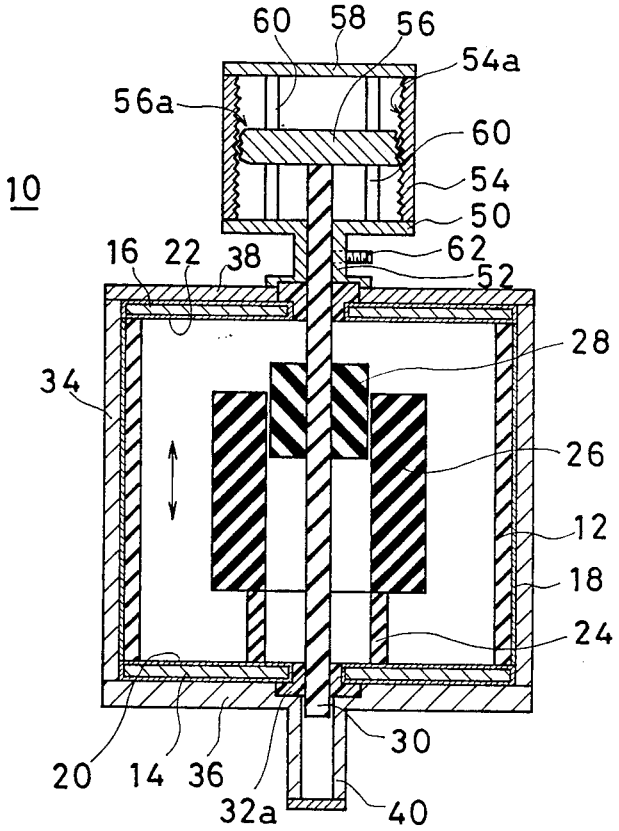
FIG. 9 is a sectional view showing another embodiment in accordance with the present invention.

FIG. 9 is a sectional view showing another embodiment in accordance with the present invention. The embodiment is similar to the embodiment for FIG. 1 except of the following points, so duplicate descriptions of similar elements will be omitted.

In this embodiment, a disc-shaped supporting plate 50 is coupled to the upper end surface (cover plate 38) of the metal case 34 by a cylindrical section 52. On the supporting plate 50, a cylindrical nut 54 is rotatably supported, on the inner circumference of which a female screw 54a is formed. A displacing member 56, having a male screw 56a which is screwed into the female screw 54a on the outer circumference thereof, is contained in the nut 54.

Above the nut 54, a cover plate 58 is provided. The nut 54 is rotatable between the supporting plate 50 and the cover 58.

The upper end of the supporting axis 30 is coupled to the lower end of the displacing member 56. Thus, the supporting axis 30 or the tuning unit 28 is displaced in the vertical direction as the displacing member 56 moves up and down. More specifically, when the nut 54 is turned, since the axial movement thereof is stopped by the supporting plate 50, the nut 54 itself will not move up and down but the displacing member 56 will be displaced in the axial direction. Thus, the supporting axis 30 and the tuning unit 28 are displaced vertically.

On the supporting plate 50, the lower ends of two pins 60 are secured, the pins 60 extending through the displacing member 56 and the above described cover 58 being fixed to the upper ends thereof. Accordingly, when the nut 54 is turned as described above, the pins 60 serve to stop the rotation of the displacing member 56.

Embodiments of the present invention have been described and illustrated in detail, it is clearly understood that the same is by way of illustration and example only and is not be taken by way of limitation, the spirit and scope of the present invention being limited only by the terms of the appended claims.

What is claimed is:

1. A dielectric resonator, comprising:

(a) a shielded casing defining a shielded space, said shielded casing comprising:

(1) a hollow case, a metallic shield electrode being formed on a surface of said case, (2) a cover plate and a bottom plate for respectively closing top and bottom ends of said hollow case, said cover and bottom plates having metallic shield electrodes formed on surfaces thereof, said shield electrodes of said cover and bottom plates conductively contacting said shield electrode of said hollow case, (b) a dielectric resonator element secured within said shielded space, a penetrating hole being formed in said dielectric resonator element, penetrating said dielectric resonator element in an axial direction thereof, (c) a tuning unit comprising a dielectric material and disposed in said penetrating hole, and being displaceable in the axial direction, (d) a supporting rod to which said tuning unit is secured, said supporting rod being held at end portions thereof by said cover plate and said bottom plate so as to penetrate said penetrating hole of said dielectric resonator for supporting said tuning unit, and (e) displacing means for acting on said supporting rod so as to displace said tuning unit in said axial direction;

wherein said dielectric resonator element is formed as a hollow cylinder;

wherein said displacing means includes screw means mounted on said shielded casing and associated with said supporting rod for being turned to displace said tuning unit; and wherein said screw means comprises an internal thread formed on said tuning unit, said supporting rod passing axially through said tuning unit, at least one end of said supporting rod being rotatable from the outside of said shielded casing, and said supporting rod being provided with an external thread which is screwed into said internal thread on said tuning unit.

2. A dielectric resonator, comprising:

(a) a shielded casing defining a shielded space, said shielded casing comprising:

(1) a hollow case, a metallic shield electrode being formed on a surface of said case, (2) a cover plate and a bottom plate for respectively closing top and bottom ends of said hollow case, said cover and bottom plates having metallic shield electrodes formed on surfaces thereof, said shield electrodes of said cover and bottom plates conductively contacting said shield electrode of said hollow case, (b) a dielectric resonator element secured within said shielded space, a penetrating hole being formed in said dielectric resonator element, penetrating said dielectric resonator element in an axial direction thereof, (c) a tuning unit comprising a dielectric material and disposed in said penetrating hole, and being displaceable in the axial direction, (d) a supporting rod to which said tuning unit is secured, said supporting rod being held at end portions thereof by said cover plate and said bottom plate so as to penetrate said penetrating hole of said dielectric resonator for supporting said tuning unit, and (e) displacing means for acting on said supporting rod so as to displace said tuning unit in said axial direction;

wherein said dielectric resonator element is formed as a hollow cylinder;

wherein said displacing means includes screw means mounted on said shielded casing and associated with said supporting rod for being turned to displace said tuning unit; and which further comprises rotation control means for controlling said tuning unit to prevent rotation thereof as said screw means is turned.

3. A dielectric resonator in accordance with claim 2, wherein said rotation control means includes (a) engaging grooves formed along the axial direction of one of the inner circumference of the penetrating hole of said dielectric resonator element and the outer circumference of said tuning unit, and (b) guide bars formed along the axial direction of the other of the penetrating hole and the tuning unit and engaging said engaging grooves.

4. A dielectric resonator, comprising:

(a) a shielded casing defining a shielded space, said shielded casing comprising:

(1) a hollow case, a metallic shield electrode being formed on a surface of said case, (2) a cover plate and a bottom plate for respectively closing top and bottom ends of said hollow case, said cover and bottom plates having metallic shield electrodes formed on surfaces thereof, said shield electrodes of said cover and bottom plates conductively contacting said shield electrode of said hollow case, (b) a dielectric resonator element secured within said shielded space, a penetrating hole being formed in said dielectric resonator element, penetrating said dielectric resonator element in an axial direction thereof, (c) a tuning unit comprising a dielectric material and disposed in said penetrating hole, and being displaceable in the axial direction, (d) a supporting rod held at end portions thereof by said cover plate and said bottom plate so as to penetrate said penetrating hole of said dielectric resonator for supporting said tuning unit, said supporting rod comprising a dielectric material having a lower dielectric constant than that of said dielectric material of said tuning unit, and (e) displacing means for acting on said supporting rod so as to displace said tuning unit in said axial direction.

5. A dielectric resonator in accordance with claim 4, wherein said dielectric resonator element is formed as a hollow cylinder.

6. A dielectric resonator in accordance with claim 2, which further comprises fixing means in said shielded casing for radially fixing said supporting rod as said tuning unit is axially displaced by said displacing means.

7. A dielectric resonator in accordance with claim 2, wherein said displacing means includes screw means mounted on said shielded casing and associated with said supporting rod for being turned to displace said tuning unit.

8. A dielectric resonator in accordance with claim 7, wherein said screw means includes a first screw which is mounted on said shielded casing and engages said supporting rod at an inner end of said first screw, said first screw having an operating portion disposed controllably from the outside of said shielded casing, and said shielded casing being provided with a second screw which engages one of said first screw and said supporting rod for preventing rotation thereof.

9. A dielectric resonator in accordance with claim 8, which further comprises a displacing member coupled to said supporting rod, said first screw being formed as an external thread on the outer circumference thereof.

10. A dielectric resonator in accordance with claim 9, which further comprises at least two pins connected to said shielded casing and extending through said displacing member for preventing the rotation thereof.

11. A dielectric resonator as in claim 4, wherein said shield electrodes are formed on substantially all surfaces of said cover plate and said bottom plate.

12. A dielectric resonator as in claim 4, wherein said hollow case, said bottom plate, and said cover plate comprise material having substantially the same linear expansion coefficient as the material of said dielectric resonator element.

13. A dielectric resonator as in claim 4, wherein said dielectric resonator is capable of being coupled to an external circuit for resonating according to a mode selected from the group consisting of the $TE_{01-\delta}$ mode and modified modes thereof.

14. A dielectric resonator as in claim 4, wherein said shielded space and said hollow case are substantially cylindrical, and said cover plate and said bottom plate are substantially circular.

* * * * *